US005743515A

United States Patent [19]

Wodell

[11] Patent Number: 5,743,515

[45] Date of Patent: Apr. 28, 1998

[54] MATERIAL HANDLING APPARATUS

[76] Inventor: William Roy Wodell, 2721 S. Kingshighway Blvd., St. Louis, Mo. 63139

[21] Appl. No.: 627,698

[22] Filed: Mar. 29, 1996

[51] Int. Cl.[6] ..... B66D 1/00

[52] U.S. Cl. ..... 254/334; 254/324

[58] Field of Search ..... 254/324, 334, 254/323; 248/163.2, 166, 332, 241

[56] References Cited

U.S. PATENT DOCUMENTS

| | | | |
|---|---|---|---|
| 2,069,697 | 2/1937 | Dempster . | |
| 2,557,466 | 6/1951 | Richards et al. | 212/8 |
| 3,128,081 | 4/1964 | Buschbom | 248/163.2 |
| 3,276,610 | 10/1966 | Thatcher . | |
| 3,774,788 | 11/1973 | Sowers et al. | 254/334 |
| 3,797,672 | 3/1974 | Vermette | 212/8 |
| 3,973,754 | 8/1976 | Chadwick, Jr. . | |
| 4,216,941 | 8/1980 | Little | 254/326 |
| 4,265,585 | 5/1981 | Hawkins | 414/541 |
| 4,338,703 | 7/1982 | Tanner | 17/44 |
| 4,854,804 | 8/1989 | Mayle | 414/469 |
| 4,860,404 | 8/1989 | Flachs | 254/334 |
| 5,188,341 | 2/1993 | Greaves | 254/323 |
| 5,393,193 | 2/1995 | Dagg | 414/540 |
| 5,427,356 | 6/1995 | Krotov et al. | 254/324 |

OTHER PUBLICATIONS

GR–1000 Bulk Bag Dispensing Unit, no date available.

Catalog of Bil–Jax, pp. 2,4,6,7,16, and 17, no date available.

*Primary Examiner*—Katherine Matecki

*Attorney, Agent, or Firm*—Armstrong, Teasdale, Schlafly & Davis

[57] ABSTRACT

A material handling apparatus for lifting and suspending bulk material including a support adapted to attach to a scaffold. The material handling apparatus further includes a load connector extending downwardly from the support adapted for engaging a bag of bulk material and a locking element connected to the support. The locking element is adapted to engage and disengage the load connector for reciprocally restricting and allowing movement of the load connector.

16 Claims, 9 Drawing Sheets

MATERIAL HANDLING APPARATUS

FIELD OF INVENTION

This invention relates generally to handling materials at construction sites and more particularly, to a material handling apparatus for lifting and suspending bulk material bags in position for use.

BACKGROUND OF THE INVENTION

Heavy materials are frequently lifted, loaded, and moved from place to place at construction sites. For example, loaded pallets, raw materials and finished goods are often loaded and unloaded into truck beds or other locations. Some materials used at construction sites such as masonry mortar and cement mix are transported to the site in bags weighing thousands of pounds. Moving and positioning these materials usually requires the use of high-powered equipment due to the large size and weight of materials involved. Smaller construction sites, however, do not require the large quantities of material or the amount of high-powered equipment required for larger sites. One method of avoiding the use of high-powered equipment in preparing masonry mix at smaller construction sites involves using smaller bags of masonry mortar weighing, for example, under 100 pounds. Each bag is manually transported and emptied into a mortar mixer. Other ingredients such as sand, water and dye are then added to the mixer to complete preparation of the mix. However, preparing the mixture on site is time consuming and results in quality and product variances in the resulting mixture. Another method which avoids the limitations of on site mixing includes using bulk mortar mixtures which are premixed and stored in large bags. These bags are extremely heavy, for example 2000–3000 pounds, thus cannot be transported manually. Accordingly, using bulk bags of mortar mix requires using high-powered engines to lift the bags. The bags are then emptied into large containers suitable for holding quantities in excess of 10,000 pounds. The containers are then moved using high-powered engines to the desired location of use. However, the use of power lifting equipment in this method has disadvantages. For example, power lifting equipment is not readily available in more remote construction sites. Moreover, even when power lifting equipment is available, restrictions such as space limitations and the costs involved may prohibit the use of such equipment especially for small scale operations. In addition, typical power lifting equipment is limited in that it merely lifts the bags, thus requiring extra equipment to hold the materials and position them for use.

Accordingly, it is desirable and advantageous to provide a material handling apparatus that lifts and suspends bulk materials such as large reusable bags of masonry mortar and dry sand mix in position for use without requiring high-powered machinery. It is also desirable and advantageous to provide an apparatus which his not expensive to manufacture that lifts and suspends a bag of bulk material.

An object of the present invention is to provide an apparatus that is lightweight and easy to assemble that lifts and suspends a bag of bulk material.

Another object of the present invention is to provide an apparatus that both lifts and suspends a bag of bulk material in position for use without requiring extra machinery.

Yet another object of the present invention is to provide such an apparatus that fits on standard scaffold.

Another object of the present invention is to provide such an apparatus that fits several different sizes of scaffold.

Still another object of the present invention is to provide an apparatus for suspending full bulk material bags for dispensing the material therefrom without requiring a large dispenser.

SUMMARY OF THE INVENTION

These and other objects are attained by a material handling apparatus which in one embodiment, secures to the top of standard scaffolding, and includes a support adapted to fit across the top of a scaffold. A load connector extends downwardly from the support and engages a bag of bulk material. The material handling apparatus in the one embodiment, also includes a locking element connected to the support. The locking element engages and disengages the load connector for reciprocally restricting and allowing movement of the connector downwardly or upwardly to lift and suspend the bag of bulk material. The bag of bulk material is lifted by the connector, engaged on the locking element, and suspended over a mortar mixer or other apparatus so that the material is readily and easily dispensed into the mixer for use.

The material handling apparatus provides an apparatus which lifts bags of bulk materials weighing, for example, 3,000 pounds without requiring high-powered equipment. In addition, the material handling apparatus may be used to lift loaded pallets, raw materials and finished goods into and out of truck beds or other locations. The material handling apparatus can be easily installed and assembled on site by two persons and operated by one person. More specifically, the material handling apparatus is advantageous for small scale construction jobs which do not require high-powered equipment to handle capacities in excess of 10,000 pounds. Furthermore, the material handling apparatus is sized to fit in commercial buildings where the typical bulk mortar systems are too large to be used. The material handling apparatus in this embodiment uses bulk bags directly on site without requiring a large dispenser or high-powered equipment to lift and position the material.

DETAILED DESCRIPTION

Figure 1:
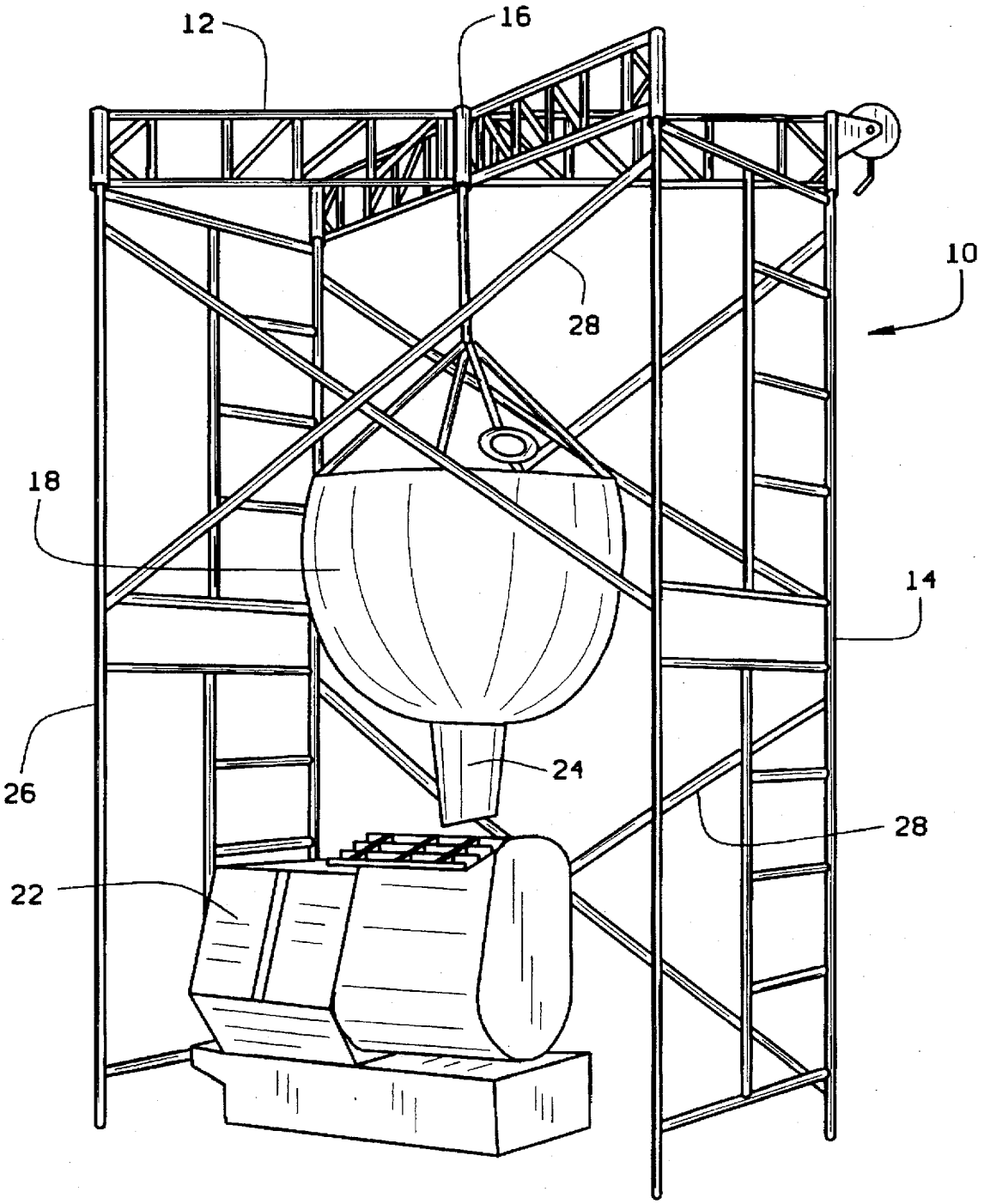
FIG. 1 is a perspective view of a material handling apparatus constructed in accordance with one embodiment of the present invention.

FIG. 1 is a perspective view of a material handling apparatus 10 in accordance with one form of the present invention. Material handling apparatus 10 provides for the lifting and suspending of bags of bulk materials such as masonry mortar and dry sand mix without requiring high-powered equipment. The bags may be lifted up from the back of a truck or other loading vehicle and suspended over a masonry mortar mixer or other apparatus in position for use. Particularly, material handling apparatus 10 includes a support 12 adapted to attach to commercially available scaffold 14, a load connector 16 extending downwardly from support 12 adapted for engaging a bag of bulk material 18 and a locking element 20 connected to support 12 adapted to engage and disengage load connector 16 for reciprocally restricting and allowing movement of load connector 16. Load connector 16 lifts the bag of bulk material 18 and suspends it over a masonry mortar mixer 22 or cement mixer in a position suitable for dispensing. In one embodiment, bag of bulk material 18 has a dispenser valve 24 at its lower portion for dispensing the material into the mixer 22.

More specifically, support 12 attaches to scaffold 14. Specific part sizes suitable for use in material handling apparatus 10 vary depending on the overall size of material handling apparatus desired. Scaffold 14 is assembled using parts such as Wide Base Frame type ST-SX-WB, with heavy-duty frame tube sizes, preferably 1.69" tube size (7), double step frame types ST-56D, ST-564D or ST-566D, and diagonal pivoted brace types ST-72-7, ST-72-8 and ST-72-10 from Bil-Jax of 595 East Lugbill Road, Archbold, Ohio 43502. Scaffold 14 is assembled by joining two step type frames 26 together with pivotal diagonal braces 28. Alternatively, other types of frames could be used such as wide base frames. The step type frames 26 are positioned facing each other and pivotal diagonal braces 28 attach to the inner edges of the vertical tubing of step type frames 26. For example, in one method which is well-known in the art, the ends of pivotal diagonal braces 28 are notched or have holes therethrough for engaging extensions on the vertical tubing of step type frames 26. Diagonal braces 28 are positioned to join the top and bottom of the frames 26. In one embodiment, two diagonal braces 28 join the tops of frames 26, one in the front and one in the back, and only one diagonal brace 28 joins the bottoms of the frames 26 in the back, as discussed more fully below. The base of each side of scaffold 14 may be adjusted to accommodate differences in the ground surface by using feet such as a steel plate having a bottom surface with a rubber patch or spikes. In addition, outriggers (not shown) may be staked from scaffold 14 into the ground for extra support of apparatus 10.

Figure 2:
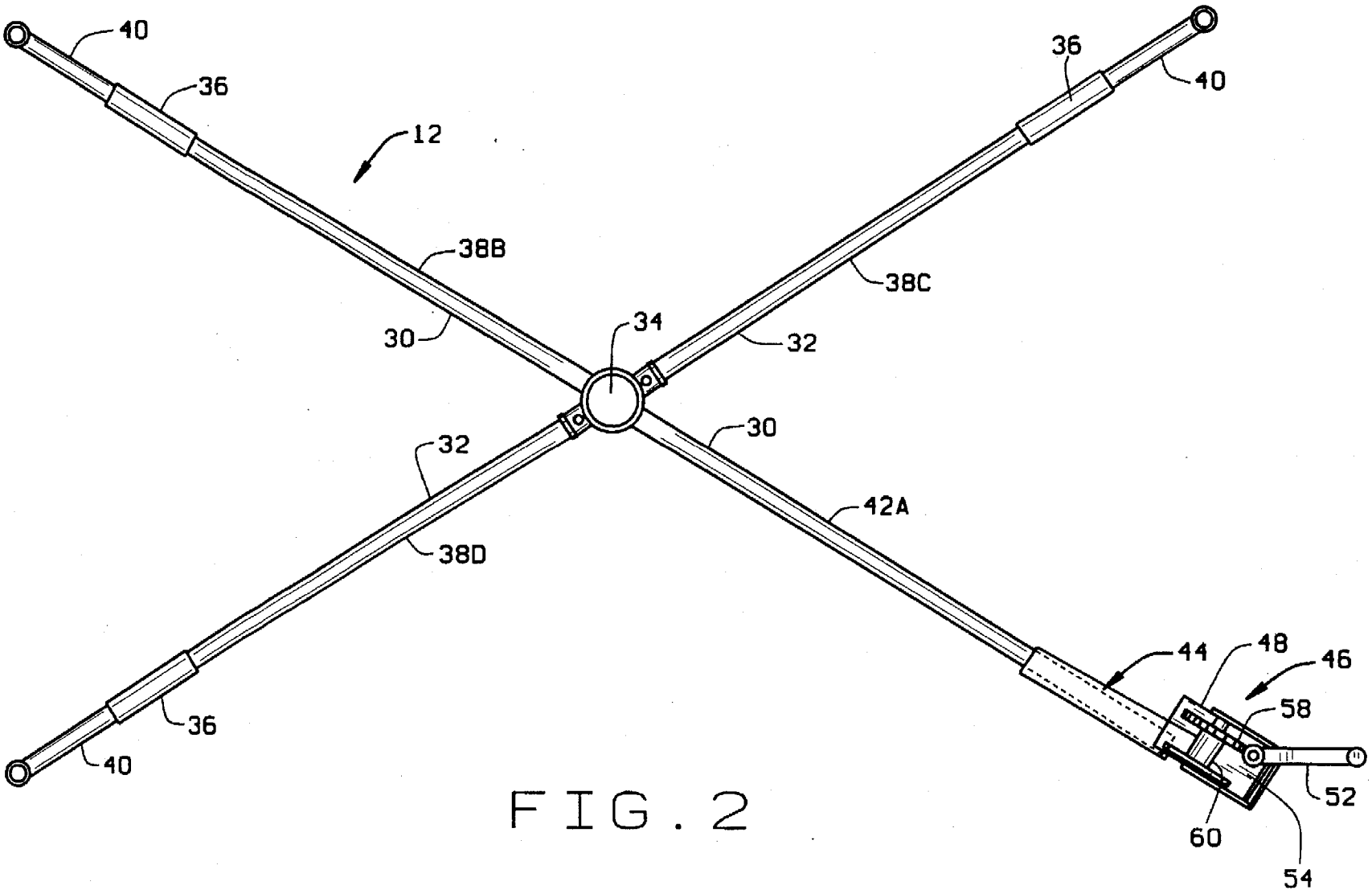
FIG. 2 is a top plan view of a support.

As shown in FIG. 2, support 12 is configured in a crosspiece formation to attach across the top of the scaffold. In particular, each end of support 12 secures to a top corner of scaffold frames 26. Support 12 comprises a fixed arm 30 and a pivoting arm 32 which together each form one of the two diagonal legs of the support. Pivoting arm 32 pivots at a center hub 34 to form a generally straight piece in alignment with fixed arm 30 wherein pivoting arm 32 aligns adjacent fixed arm 30 thereby facilitating storage and transport of support 12. In addition, pivoting arm 32 provides for adjustment of the angle between arms 30 and 32 to accommodate various scaffold span sizes as well as manufacturing differences such as tube shapes. Support 12 includes adjusters 36 for adjusting support 12 to fit a plurality of sizes of scaffold. In particular, adjusters 36 comprise a hollow cylindrical tubing having a diameter slightly larger than the diameter of horizontal tubes 38B, 38B', 38C, 38C', 38D and 38D' which form the first side of fixed arm 30 and both sides of pivoting arm 32 respectively (discussed more fully below). Adjusters 36 have openings at each end for receiving the ends of tubes 38B, 38B', 38C, 38C', 38D and 38D' and the ends of an extension adaptor 40 so that extension adapters 40 extend outwardly from each side of adjusters 36 thereby joining adjusters to the tubes and extending the length of arm 32 and one side of arm 30. To adjust support 12, the first ends of adjusters 36 receive horizontal tubes 38B, 38B', 38C, 38C', 38D and 38D' and the second ends of adjusters receive adapters 40. Thus depending on the length of extension adapters 40 inserted into adjusters 36, support 12 is adjustable to fit over a plurality of scaffold sizes including those having span sizes of 7 feet, 8 feet and 10 feet. In another embodiment, support 12 is custom made to fit the desired scaffold span size, thus adjusters 36 and extension adapters 40 are not required. The second side of fixed arm 30 is formed by horizontal tubes 42A and 42A'. Horizontal tubes 42A and 42A' are longer and thicker than horizontal tubes 38B, 38B', 38C, 38C', 38D, and 38D' so that they are more suited for supporting the weight of the load and compression from cable tension. Horizontal tubes 42A and 42A' include winch adapters 44 attached to their ends opposite center hub 34 which replace adjusters 36 and adapters 40. Winch adapters 44 are thicker and stronger than adapters 40 to support a winch assembly 46. Winch adapters 44 are secured to horizontal tubes 42A and 42A' and adjusters 36 are secured to the horizontal tubes with cross bolts (not shown).

Figure 3:
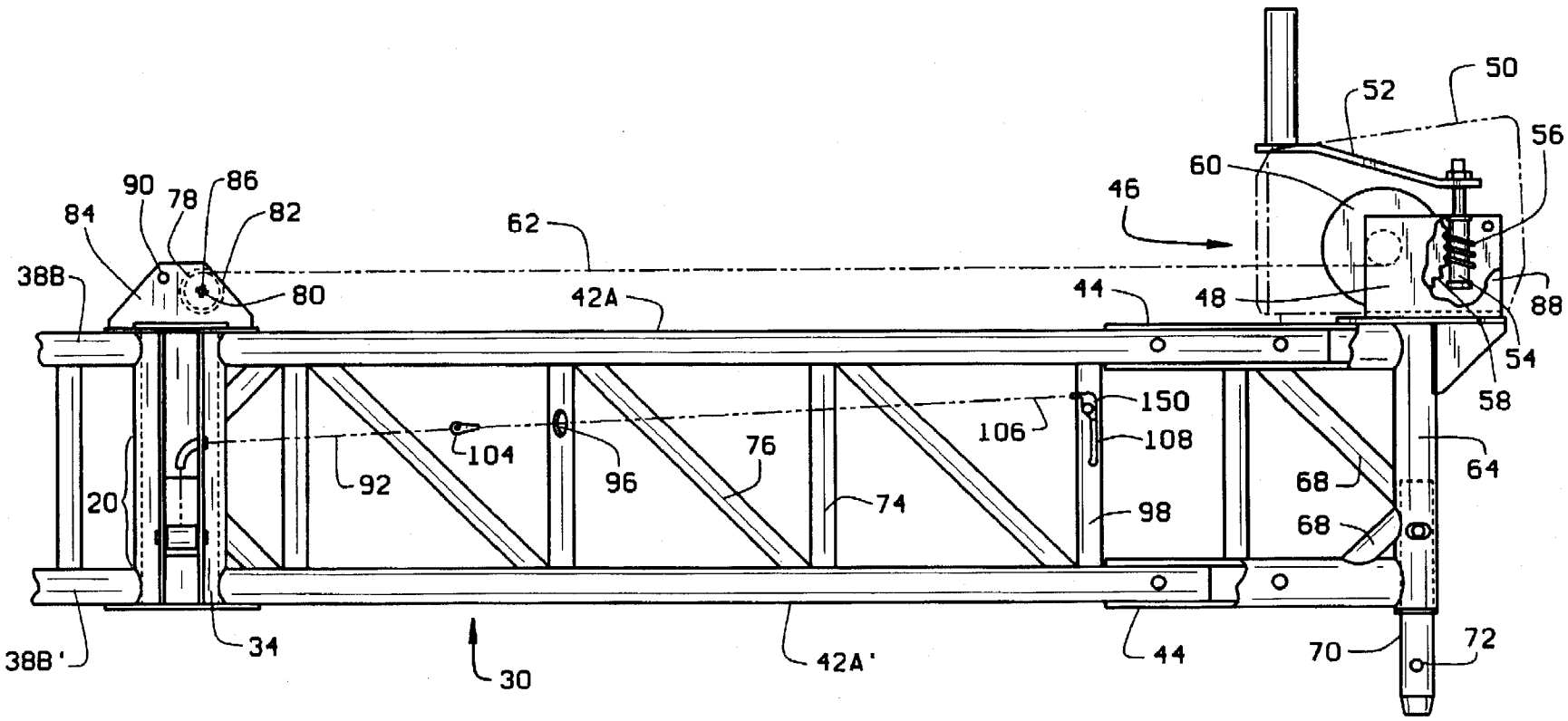
FIG. 3 is a side plan view of a leg of the support including a winch assembly for the material handling apparatus shown in FIG. 1.

In the embodiment shown in FIG. 3, fixed arm 30 includes winch assembly 46 for moving load connector 16 upward or downward. Winch assembly 46 includes a mechanical winch 48 such as Worm Gear Winch No. WG2000 available from Dutton-Lainson Co., Hastings, Nebr. 68902-0729 or an electric winch 50 (shown in broken lines) such as Dayton winch Nos. 4Z326 and 4Z327 available from Dayton Electric Mfg. Co., 5959 West Howard Street, Niles, Ill. 60714. Both mechanical winch 48 and electrical winch 50 are non-reversing types which prevent loads from unspooling from the winch spools. For example, mechanical winch 48 is a worm drive type which is operated by turning a handle 52 clockwise to rotate a winch spool 54 forward. More specifically, winch spool 54 includes grooves 56 which slidably engage nubs 58 on the outer surface of a cable spool 60. As cable spool 60 is rotated forward, a cable 62 is wound onto cable spool 60. Alternatively, electrical winch 50 in one embodiment can be powered by either a 115V AC or a 12V DC motor and includes a clutch and a brake (not shown) to prevent reverse movement of the spool and unwinding of the cable 62. Winch assembly 46 is mounted on fixed arm 30 opposite center hub 34. In an alternate embodiment, electric winch 50 is mounted directly over center hub 34.

Fixed arm 30 includes upper horizontal tubes 42A and 388 and lower horizontal tubes 42A' and 38B'. On the first side of fixed arm 30, horizontal tubes 388 and 38B' extend from center hub 34 through adjusters 36. Adapters 40 extend from adjusters 36 into end vertical support tubes 66. On the second side of fixed arm 30 upper horizontal tube 42A and lower horizontal tube 42A' extend from center hub 34 through winch adapters 44 and into a winch end vertical support tube 64. Similarly, one side of pivoting arm 32 includes upper horizontal tube 38C and lower horizontal tube 38C' which extend from center hub 34 through adjusters 36 and into adapters 40. Adapters 40 extend into end vertical support tubes 66. The other side of pivoting arm 32 includes upper horizontal tube 38D and lower horizontal tube 38D' which extend from center hub 34 into adjusters 36. Adjusters 36 receive adapters 40 which extend into end vertical support tubes 66. Corner braces 68 fit between the lower horizontal tubes and winch end vertical support tube 64 or end vertical support tube 66 to secure support 12 and provide additional reinforcement. Scaffold pins 70 fit between end vertical support tubes 64 and 66 and scaffold 14 thereby securing support 12 to scaffold 14. In particular, cross bolts (not shown) fit through aligned holes 72 and secure support 12 to scaffold 14.

Each set of horizontal tubes include a series of interconnected tubes for reinforcing fixed and pivoting arms 30 and 32 of support 12. In particular, a plurality of adjoining vertical and diagonal support tubes 74 and 76 connect the horizontal tubes of each bar portion together. In one embodiment, vertical and diagonal support tubes 74 and 76 are, for example, inserted into receiving apertures (not shown) in horizontal tubes 42A, 42A', 38B, 38B', 38C, 38C', 38D and 38D' for securing the tubes together. Adjoining vertical and diagonal support tubes 74 and 76, reinforce and strengthen support 12 so that it can lift, support and suspend a bag of bulk material 18. In one embodiment, all of the tubes 42A, 42A', 38B, 38B', 38C, 38C', 38D, 38D', 74 and 76 are made from commercially available structural steel tubing such as the 1.50" diameter or square type tube from Joseph T. Ryerson & Son, Inc., 2621 West 15th Place, Chicago, Ill. 60608.

A center pulley 78 is attached to load connector 16. Center pulley 78 has a central aperture 80, and a cable receiving channel 82 therethrough. Center pulley 78 is attached to support 12 by bracket 84 at the center of center hub 34 so that cable 62 is aligned centrally through hub 34 thereby aligning load connector 16 and locking element 20. Bracket 84 is mounted on the center portion of support 12 and extends upwardly positioning center pulley 78 on support 12. Bracket 84 includes a hub 86 which extends perpendicularly to bracket 84 and into central aperture 80 of center pulley 78. A cross bolt (not shown) fits through the end of hub 86 securing bracket 84 to center pulley 78. In one embodiment, bracket 84 includes extensions (not shown) which insert into apertures in center hub 34 for attaching bracket 84 to support 12.

On the end of fixed arm 30 opposite center pulley 78, winch assembly 46 is attached to support 12 by an end bracket 88. End bracket 88 is welded onto the top of winch vertical support tube 64 and winch adapter 44 on fixed arm 30. Cable 62 extends from the winch assembly 46 and along fixed arm 30. Cable 62 extends into cable receiving channel 82 of center pulley 78, passes by a cable guide 90, down into center hub 34 and secures to load connector 16. Cable guide 90 attaches to bracket 84 by a cross bolt (not shown). Cable guide 90 has a cable receiving surface thereon which guides cable 62 from load connector 16 into cable receiving channel 82 of center pulley 78. Cable 62 extends around center pulley 78 and into center hub 34 guided by cable guide 90 which prevents cable 62 from fouling or disengaging from cable receiving channel 82.

Locking element 20 prevents load connector 16 from freely moving through the center of support 12. In particular, locking element 20 includes a latch pawl cable 92 which extends from locking element 20 through a tube 94 connected to one side of center hub 34. Latch pawl cable extends from tube 94 outwardly towards winch assembly 46 and loops through an aperture 96 attached to a vertical spreader 98 and back into locking element 20 through a tube 100 connected to the opposite side of center hub 34. Tubes 94 and 100 are bent in a right angle configuration to guide latch pawl cable 92 from a vertical to a horizontal pull as discussed more fully below. Latch pawl cable 92 thereby forms a U-shaped yoke which includes a grip 102 for moving latch pawl cable 92 to control locking element 20. Alternatively, in another embodiment a shorter U-shaped yoke is formed wherein a connector 104 attaches at the apex of the "U." Connector 104 is fitted with an extension cable 106 which extends to a pivot handle 108 on the right end of vertical spreader 98. Pivot handle 108 controls movement of latch pawl cable 92 which controls locking element 20.

Figure 4:
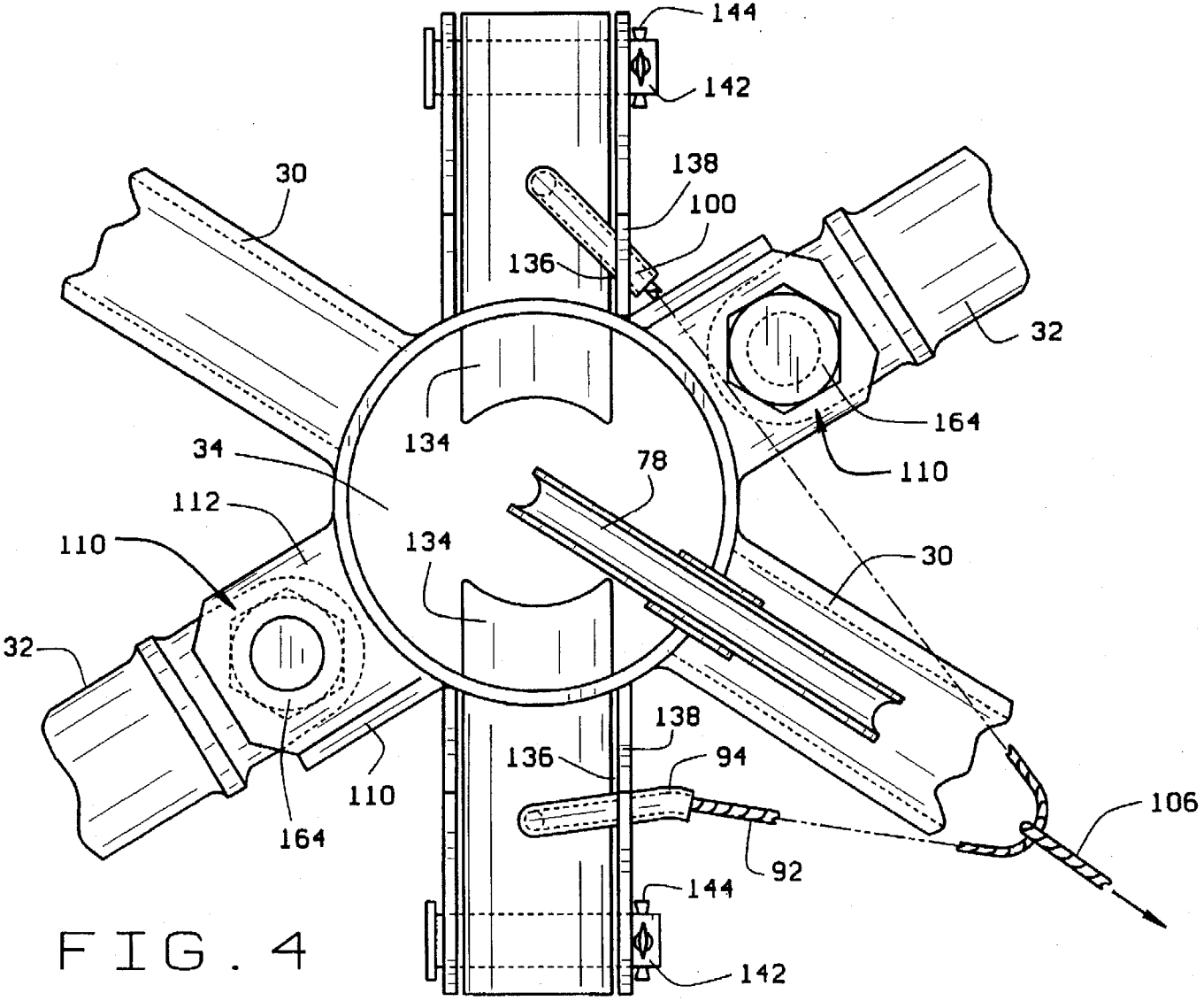
FIG. 4 is a top plan view of a support in part.

FIG. 4 illustrates fixed arm 30 and pivoting arm 32 inserted into center hub 34. Pivoting arm 32 pivots about center hub 34 to form a generally straight configuration for ease of storage and transport. In particular, pivoting arm 32 includes joints 110 which allow rotation of pivoting arm 32 clockwise towards fixed arm 30. Thus, the portion of pivoting arm 32 on the left side of center hub 34 pivots towards the portion of fixed arm 30 on the right side of center hub 34. Similarly, the portion of pivoting arm 32 on the right side of center hub 34 pivots towards the portion of fixed arm 30 on the left side of center hub 34. Pivoting arm 32 pivots both counter-clockwise and clockwise to accommodate various scaffold span sizes. However, the configuration of support 12 remains in a generally cross-shaped configuration when attached to scaffold 14. A gusset 110 is welded to center hub 34 and pivot plates 112 which extend from hub 34. Gusset 110 provides support and spacing between the plates and prevents excessive opening of pivoting arm 32 away from fixed arm 30.

Figure 5:
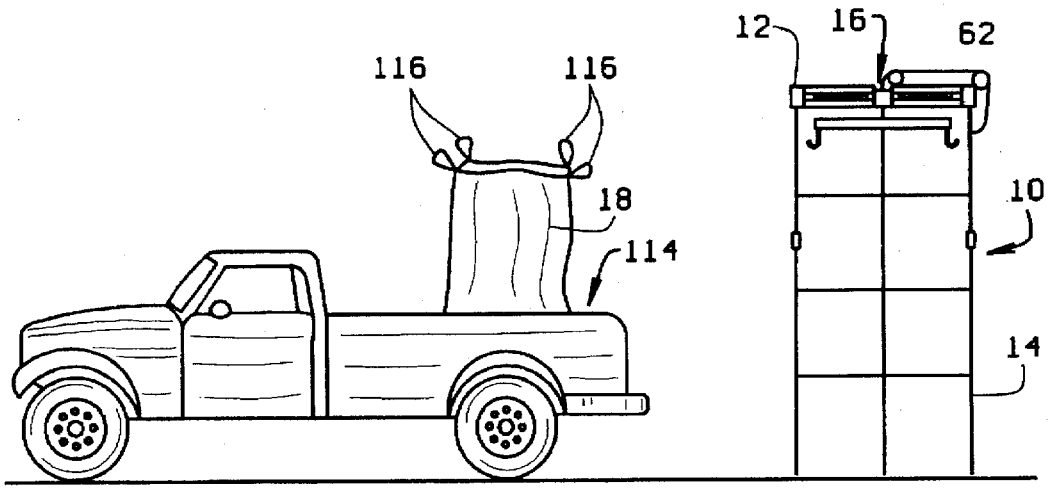
FIG. 5 is a side plan view of a material handling apparatus shown with a vehicle backing into position to have a bag of bulk material lifted therefrom.

FIG. 5 illustrates a side view of material handling apparatus 10 including load connector 16. Load connector 16 lifts and suspends a bag of bulk material 18 in position for use. Material handling apparatus 10 is adapted to lift a bag of bulk material 18 from an exterior source, such as the back of a pickup truck 114. The bag of bulk material 18 includes at least one loop 116, and typically includes four loops extending from its side for securely fitting to the material handling apparatus 10.

Figure 6:
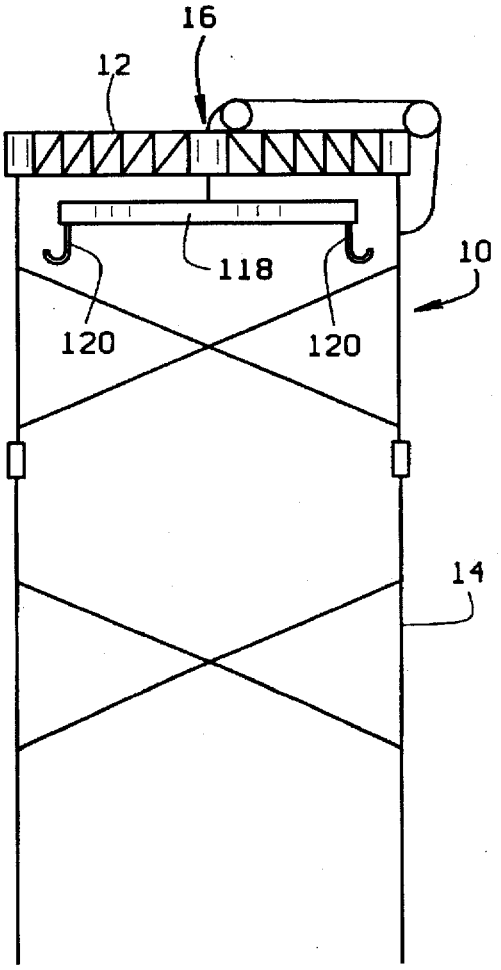
FIG. 6 is a front plan view of a material handling apparatus in FIG. 5.

More specifically, as shown in FIG. 6, support 12 includes a load adaptor 118 extending downwardly from support 12. In one embodiment, load adaptor 118 includes hooks 120 which attach to the loops 116 on bag 18 so that apparatus 10 may lift bag 18 from pick-up truck 114 or other location and suspend bag 18 in position for dispensing.

Figure 7:
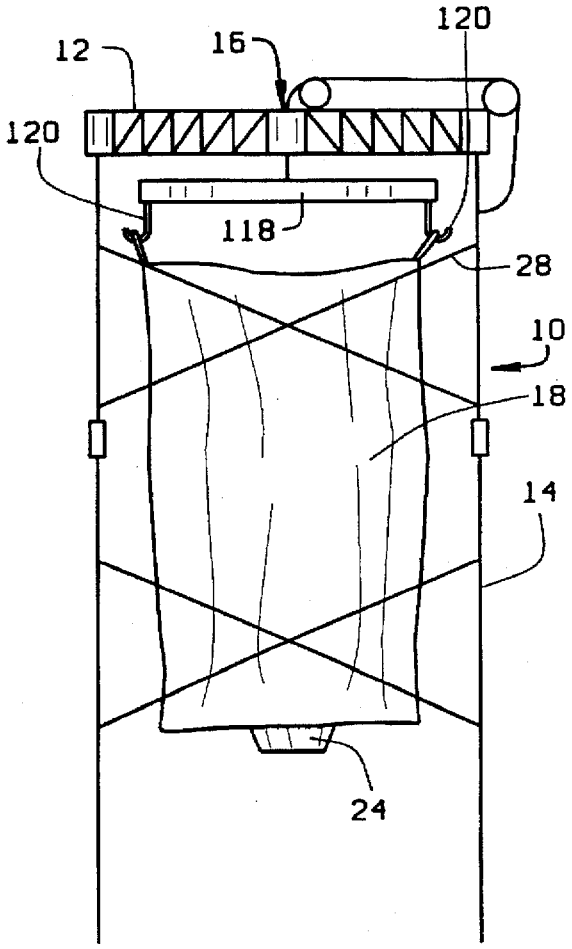
FIG. 7 is a front plan view of a material handling apparatus in FIG. 5 shown suspending a bag of bulk material.

FIG. 7 illustrates material handling apparatus 10 suspending a bag of bulk material 18. The bag of bulk material 18 such as masonry mortar includes dispenser valve 24 at its lower portion for dispensing the mix over mortar mixer 22 (not shown). As discussed previously, in one embodiment scaffold 14 is assembled without a lower front pivotal diagonal brace 28 so that a vehicle may easily back inside the scaffold frame and position a bag of bulk material 18 under the material handling apparatus 10 for lifting.

Figure 8:
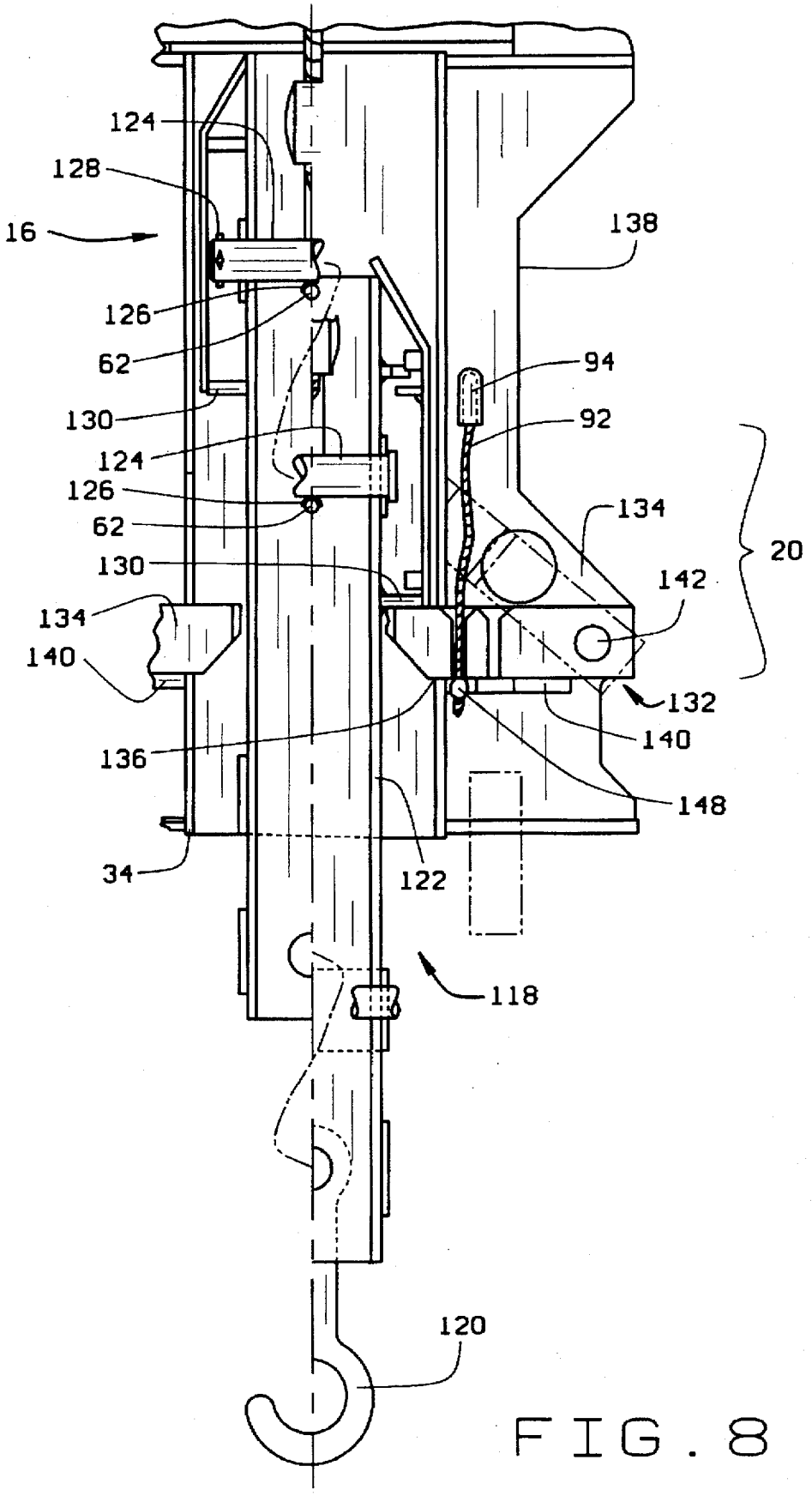
FIG. 8 is a side plan view in split level of a load connector for the material handling apparatus shown in FIG. 5.

FIG. 8 illustrates a split level side plan view of the load connector 16. Load connector 16 and locking element 20 of the material handling apparatus 10 are positioned proximal to center hub 34. Cable 62 attaches to a load support beam 122 extending upwardly from load adaptor 118. Load support beam 122 includes a clevis pin 124 for securely receiving cable 62. More specifically, in one embodiment, cable 62 includes a looped portion which loops around a cable thimble 126 at its lower end which may be formed by partial splicing of cable 62. The clevis pin 124 extends through load support beam 122, cable thimble 126, and the surrounding loop of cable 62. A cotter pin 128 extends through the end of clevis pin 124 thereby securing cable 62 to load support beam 122. In one embodiment, load adaptor 118 comprises a guide cone for securing cable 62 to the adaptor. The guide cone has an aperture for receiving the cable 62 therethrough and closes around cable 62 and hooks 120 with a star lock. The movement of load adaptor 118 is restricted by locking element 20. Load support beam 122 includes a shoulder portion 130 extending outwardly around its entire circumference which is engaged and disengaged by locking element 20.

Locking element 20 comprises latch assemblies 132 which attach to the lower portion of center hub 34 by welding. Latch assemblies 132 include latch pawls 134 which fit into apertures 136 extending into center hub 34. Latch assemblies 132 attach to center hub 34 by latch brackets 138 which are for example, bolted or welded onto latch supports 140 on center hub 34. Latch pawls 134 pivotally secure to latch brackets 138 by latch pivot clevis pins 142. Pivot clevis pins 142 extend through apertures in the outer portions of latch pawls 134 and are secured in position with cotter pins 144. Latch pawls 134 pivot upwardly about latch clevis pins 142, however, they are prevented from lifting too high or reversing by unlock stops (not shown) which attach on latch supports 140.. Latch pawls 134 include cable apertures 146 extending through their centers for receiving latch pawl cable 92 therethrough. Latch pawl cable 92 extends through cable apertures 146 and is prevented from completely passing through apertures 146 by an enlarged cable end 148. Latch pawl cable 92 passes through a first latch pawl 134 into tube 94, through aperture 96 on vertical spreader 98, through tube 100 and then into a second latch pawl 134 through its cable aperture 146 thereby forming the U-shaped yoke. Tubes 94 and 100 change direction of cable 92 from vertical to horizontal, so that latch assemblies 132 can be pulled up to release load adaptor 118. In one embodiment, latch pawl cable 92 is operated by pivot handle 108 on a latch control element 150 located on the outside of fixed arm 30 near winch assembly 46 for easy access.

In operation, latch control element 150 is controlled to pull latch pawl cable 92 upwardly which causes an upward pull on apertures 146. This upward pull causes latch pawls 134 to pivot upwardly thereby disengaging shoulder 130 allowing load support beam 122 to freely move downwardly so that hooks 120 can move downwardly into position and secure loop 116 in a bag of bulk material 18 (as shown in phantom lines on the right side of split level FIG. 8). In particular, latch pawls 134 drop down by gravity or are forced down by a spring.

Alternatively, when load connector 16 is moved upwardly by cable 62, a bag of bulk material 18 may be suspended in position for dispensing by locking element 20. More specifically, latch control element 150 is controlled to release latch pawl cable 92 downwardly allowing latch pawls 134 to rest adjacent bracket latches 138 thereby engaging load support beam 122 by blocking downward movement of shoulder portion 130 as shown on the right side of split level FIG. 8.

Figure 9:
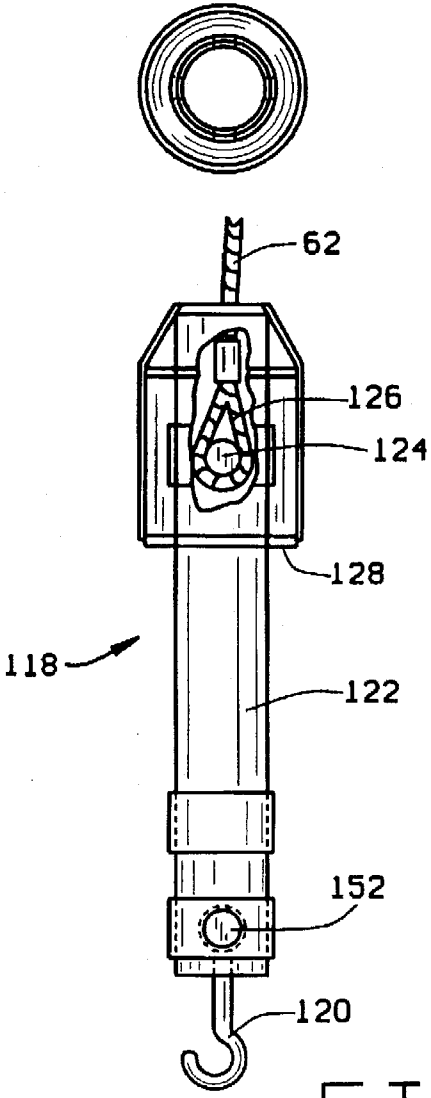
FIG. 9 is a side plan view of one embodiment of a load adaptor.

FIG. 9 illustrates one embodiment of load adaptor 118. As discussed previously, cable 62 attaches to load adaptor 118 by a looped portion which is received around cable thimble 126 and clevis pin 124. Thus, as winch assembly 46 is operated, load adaptor 118 is lifted by cable 62. Load adaptor 118 includes a hook 120 at its lower end for supporting bag of bulk material 18. In addition, load adaptor 118 includes cross holes 152 at its lower end for mounting different types of load adapters such as a spreader sling shown in FIG. 1 or a bar 154 as shown in FIG. 10.

Figure 10:
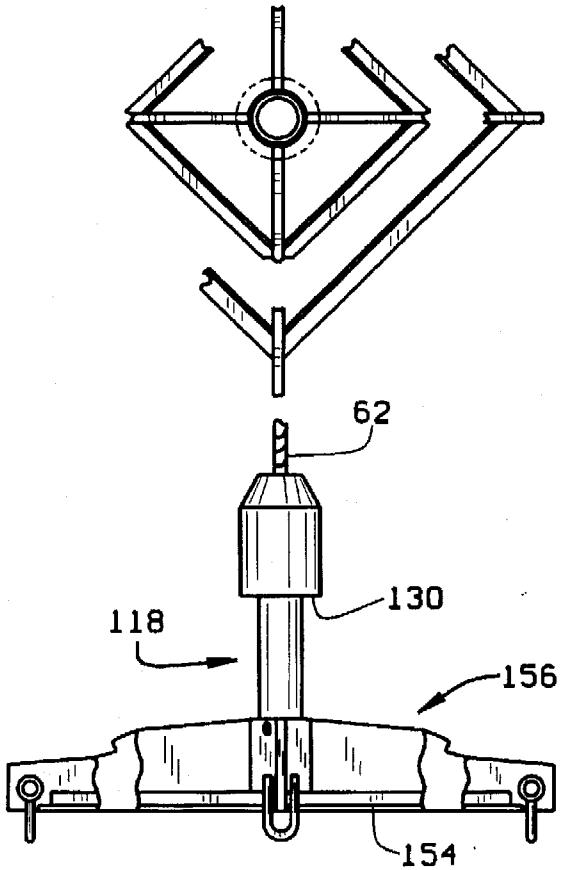
FIG. 10 is a side plan view of one embodiment of a four arm adaptor connected to the load adaptor of FIG. 9.

More specifically, FIG. 10 illustrates a special four arm adaptor 156 for suspending and lifting bag of bulk material 18. Four arm adaptor 156 bolts to load adaptor 118 by inserting bolts (not shown) into cross holes 152.

Figure 11:
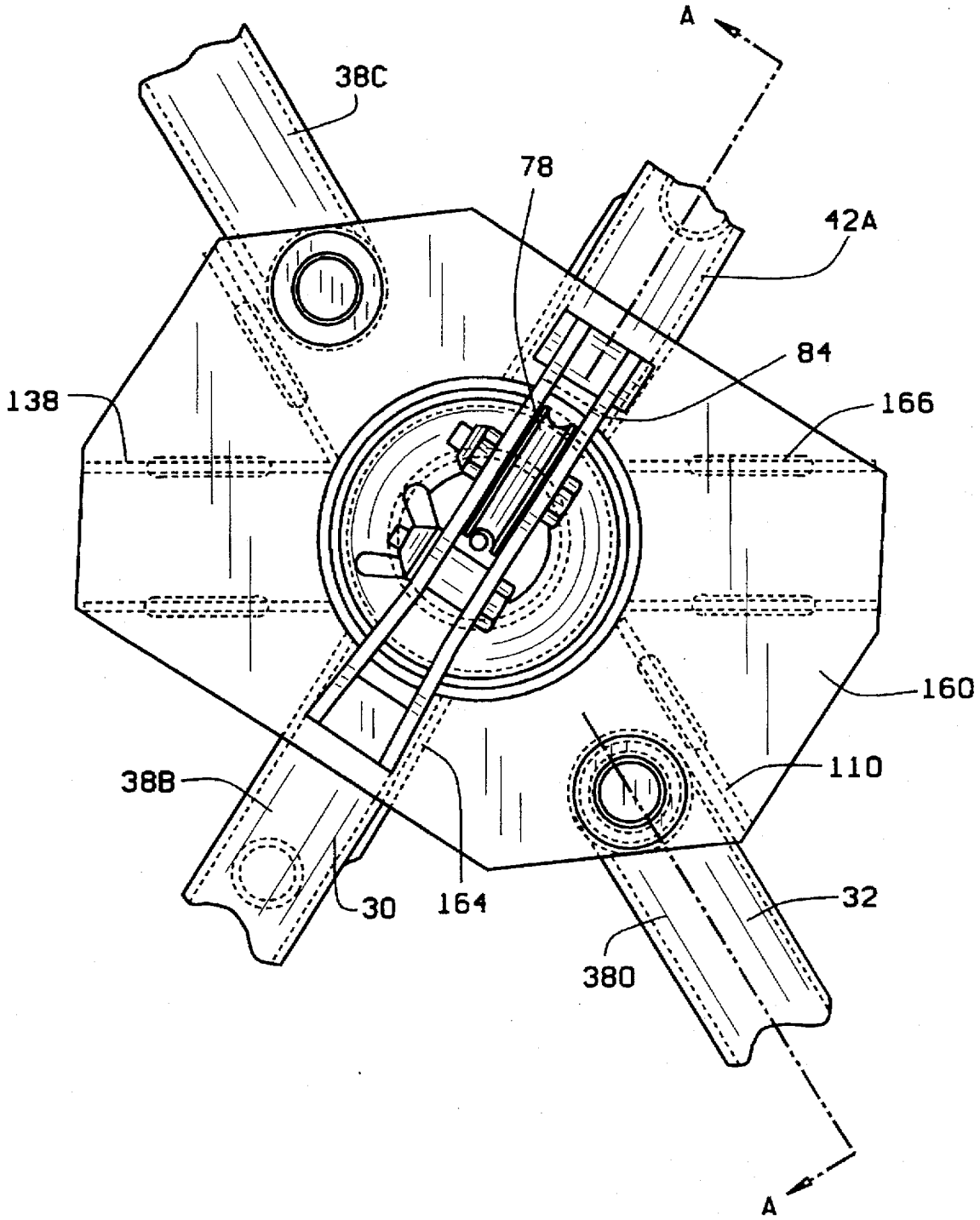
FIG. 11 is a top plan view of a second embodiment of a support including a top connector plate for the material handling apparatus shown in FIG. 5.

FIG. 11 illustrates an alternate center hub 34 including generally rectangular connector plates 160 and 162 for covering the top and bottom respectively, of center hub 34. Top and bottom plates 160 and 162 include weld apertures 164 to secure tubes 42A, 42A', 38B and 38B' to top and bottom connector plates 160 and 162 by welding or other suitable means. Top and bottom connector plates 160 and 162 include plug/weld slots 166 which receive tabs on parts which connect to the plates. More specifically, fixed arm 30 and latch bracket 138 are welded onto top and bottom connector plates 160 and 162. In addition, a pulley bracket 84 is welded onto top connector plate 162 through plug weld slot 166.

Figure 12:
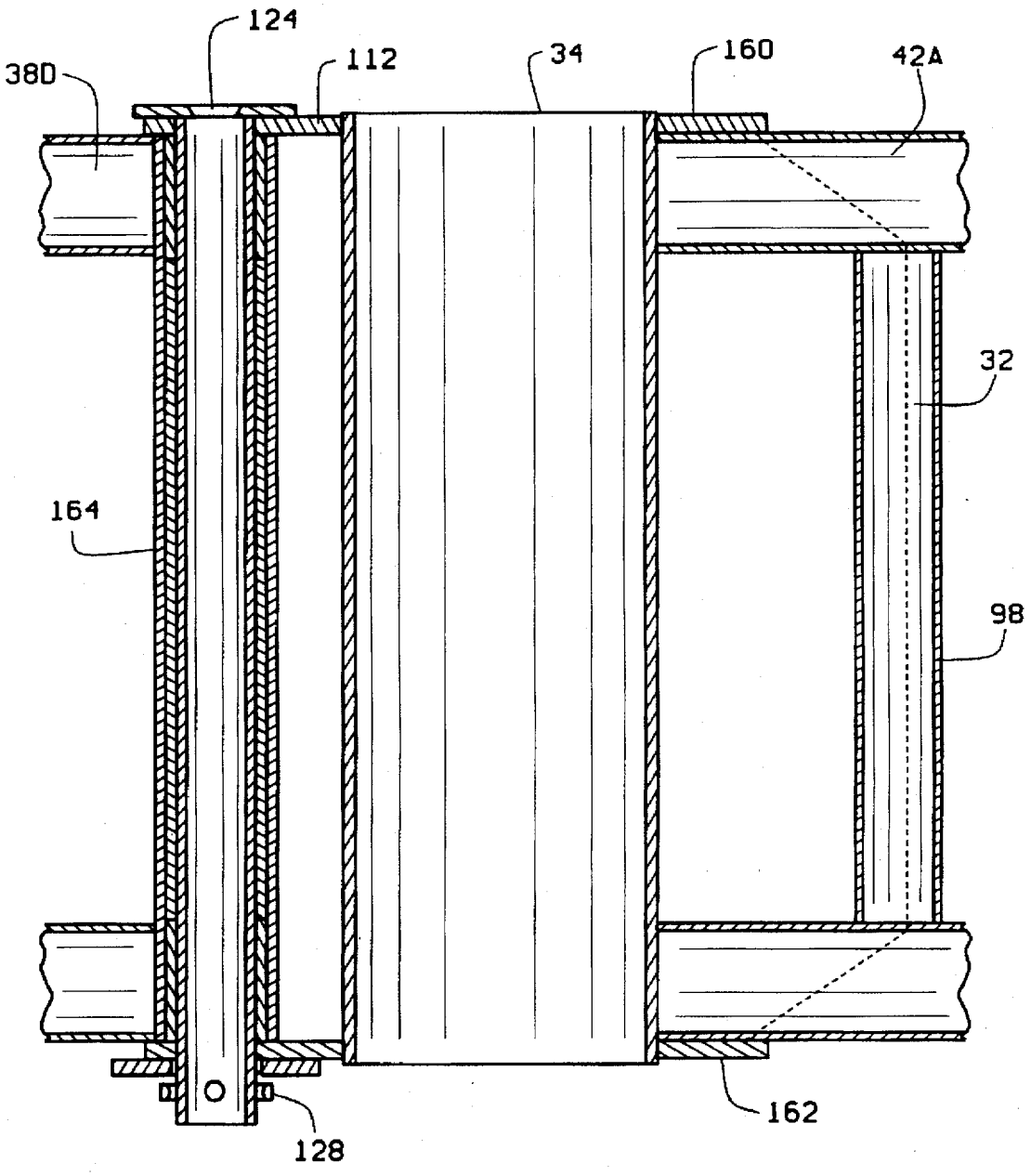
FIG. 12 is a cross-sectional view taken along lines A—A in FIG. 11 of the second embodiment of the support.

The second embodiment of support 12 shown in FIG. 12 illustrates a sectional view through lines A—A in FIG. 11 of top and bottom connector plates 160 and 162 providing for additional reinforcement of support 12. Top connector plate 160 and bottom connector plate 162 enclose horizontal tubes 42A, 42A', 38B, 38B', 38C, 38C', 38D and 38D' in center hub 34. Each joint 104 includes a vertical pivot sleeve 164 which provides for spacing between parallel tubes such as 38C and 38C'. Vertical pivot sleeve 164 provides a guide for latch pivot clevis pins 142 for pivoting arm 32. In one embodiment, an intercostal 166 may be welded to interconnect center hub 34, horizontal tubes, top connector plate 160, bottom connector plate 162 and vertical spreader 98.

In operation, locking element 20 releases load connector 16 so that it may engage a bag of bulk material 18. Load connector 16 is then moved upwardly by a winch or other power source lifting the bag of material to a suspended position. Load connector 16 is then lowered onto latch pawls 134 to lock bag 18 into suspended position. A masonry mixer 22 or other apparatus is then positioned under bag 18 so that the contents of the bag may be dispensed through dispenser valve 24 and received by masonry mixer 22.

From the preceding description of several embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

I claim:

1. A material handling apparatus for attaching to a scaffold for lifting and suspending a bag of bulk material, comprising:

a support adapted to attach to the scaffold, wherein said support forms a cross-piece over the top of the scaffold, wherein said support further comprises a hub, said hub located generally centrally on said cross-piece, said cross-piece has at least one side that rotates about said hub to form a generally straight piece;

a load connector extending downwardly from said support adapted for engaging the bag of bulk material; and a locking element connected to said support, said locking element adapted to engage and disengage said load connector for reciprocally restricting and allowing movement of said load connector.

2. The material handling apparatus in accordance with claim 1 further comprising a center pulley attached to the center hub of said support, said center pulley having a cable receiving channel, and a winch assembly attached to an outer edge of said support, said winch assembly having a cable receiving surface, a cable extending through said cable receiving surface of said winch assembly and said cable receiving channel of said center pulley, said cable attached to said load connector.

3. The material handling apparatus in accordance with claim 1 wherein said support is adjustable to fit a plurality of scaffold sizes.

4. The material handling apparatus in accordance with claim 1 wherein said load connector further comprises at least one hook for securing to a loop portion extending from an edge of the bag of bulk material.

5. A material handling apparatus for lifting and suspending a bag of bulk material comprising:

a scaffold comprising a series of rods interconnected to form a frame;

a support adapted to attach to the top of said scaffold, said support having a center hub;

a load connector extending downwardly from said support adapted for engaging the bag of bulk material; and a locking element connected to said support, said locking element adapted to engage and disengage said load connector for reciprocally restricting and allowing movement of said load connector.

6. The material handling apparatus in accordance with claim 5 further comprising a center pulley attached to the center hub of said support, said center pulley having a cable receiving channel, and a winch assembly attached to an outer edge of said support, said winch assembly having a cable receiving surface, a cable extending through said cable receiving surface of said winch assembly and said cable receiving channel of said center pulley, said cable attached to said load connector.

7. The material handling apparatus in accordance with claim 5 wherein said support forms a cross-piece over the top of said scaffold.

8. The material handling apparatus in accordance with claim 5 wherein said load connector further comprises at least one hook for securing to a loop portion extending from an edge of the bag of bulk material.

9. A material handling apparatus for lifting and suspending a bag of bulk material comprising:

a support adapted to attach to the top of a scaffold, wherein said support forms a cross-piece over the top of said scaffold wherein said support further comprises a hub having joints, said hub being generally centrally located on said cross-piece, said cross-piece has at least one side that rotates about said hub in said joints to form a generally straight piece;

a scaffold comprising a series of rods interconnected to form a frame;

a load connector extending downwardly from said support adapted for engaging the bag of bulk material; and a locking element connected to said support, said locking element adapted to engage and disengage said load connector for reciprocally restricting and allowing movement of said load connector.

10. A material handling apparatus for attaching to a scaffold for lifting and suspending a bag of bulk material, comprising:

a support adapted to attach to the scaffold, said support having a center hub, wherein said support forms a cross-piece over the top of the scaffold;

a load connector extending downwardly from the support adapted for engaging the bag of bulk material;

a center pulley attached to the center of said support, said center pulley having a cable receiving channel;

a winch assembly attached to an outer edge of said support, said winch assembly having a cable receiving surface and a cable extending through said cable receiving surface of said winch assembly and said cable receiving channel of said center pulley, said cable attached to said load connector; and a locking element connected to said support, said locking element adapted to engage and disengage said load connector for reciprocally restricting and allowing movement of said load connector.

11. The material handling apparatus in accordance with claim 10 wherein said support is adjustable to fit a plurality of scaffold sizes.

12. The material handling apparatus in accordance with claim 10 wherein said load connector further comprises at least one hook for securing to a loop portion extending from an edge of the bag of bulk material.

13. A material handling apparatus for attaching to a scaffold for lifting and suspending a bag of bulk material, comprising:

a support adapted to attach to the scaffold, wherein said support is adjustable to fit a plurality of scaffold sizes, wherein said support forms a cross-piece over the top of the scaffold, wherein said support is foldable, said support further comprising a hub having joints, a first leg and a second leg which pivot in said joints to fold from said cross-piece into a straight piece;

a load connector extending downwardly from the support adapted for engaging the bag of bulk material;

a center pulley attached to the center of said support, said center pulley having a cable receiving channel;

a winch assembly attached to an outer edge of said support, said winch assembly having a cable receiving surface and a cable extending through said cable receiving surface of said winch assembly and said cable receiving channel of said center pulley, said cable attached to said load connector; and a locking element connected to said support, said locking element adapted to engage and disengage said load connector for reciprocally restricting and allowing movement of said load connector.

14. A material handling apparatus for attaching to a scaffold for lifting and suspending a bag of bulk material, comprising:

a support adapted to attach to the scaffold, said support having a center hub, wherein said support forms a cross-piece over the top of the scaffold;

a load connector extending downwardly from the support adapted for engaging the bag of bulk material, and means for reciprocally moving said load connector upwardly and downwardly attached to said support.

15. The material handling apparatus of claim 14 wherein said means for reciprocally moving said load connector is a winch.

16. The material handling apparatus of claim 15 wherein said winch includes a cable having a hook at one end for engaging bulk material.

* * * * *